US006284122B1

(12) United States Patent
Memmi et al.

(10) Patent No.: US 6,284,122 B1
(45) Date of Patent: Sep. 4, 2001

(54) PRODUCTION OF A ZINC-ALUMINUM ALLOY COATING BY IMMERSION INTO MOLTEN METAL BATHS

(75) Inventors: Massimo Memmi; Bruno Brevaglieri; Stefano Natali; Michele Cecchini, all of Rome (IT)

(73) Assignee: International Lead Zinc Research Organization, Inc., Research Triangle Park, NC (US)

( * ) Notice: Subject to any disclaimer, the term of this patent is extended or adjusted under 35 U.S.C. 154(b) by 0 days.

(21) Appl. No.: 09/615,515

(22) Filed: Jul. 12, 2000

Related U.S. Application Data

(63) Continuation-in-part of application No. 09/138,049, filed on Aug. 21, 1998, now abandoned.

(60) Provisional application No. 60/088,555, filed on Jun. 9, 1998.

(51) Int. Cl.[7] ..... C25D 5/48; B05D 1/18; B05D 1/38; B05D 3/10

(52) U.S. Cl. ..... 205/220; 205/271; 205/291; 427/433; 427/436; 427/437; 427/438; 427/406; 427/320; 427/321; 427/343; 427/383.7

(58) Field of Search ..... 427/433, 436, 427/437, 438, 406, 310, 321, 320, 343, 383.7; 205/220, 269, 271, 291

(56) References Cited

U.S. PATENT DOCUMENTS

| | | | | |
|---|---|---|---|---|
| 4,228,224 | | 10/1980 | Heredy et al. . | |
| 4,285,995 | * | 8/1981 | Gomersall | 427/383.9 |
| 4,505,958 | * | 3/1985 | Lieber et al. | 427/433 |
| 5,203,985 | * | 4/1993 | Nishimura et al. | 205/193 |
| 5,827,618 | * | 10/1998 | Oyagi et al. | 428/621 |

* cited by examiner

*Primary Examiner*—Shrive P. Beck
*Assistant Examiner*—Michael Barr
(74) *Attorney, Agent, or Firm*—Baker Botts L.L.P.

(57) ABSTRACT

A process for non-continuous galvanization of a metal object with a Zn—Al alloy including the steps of pre-coating the object with a metallic layer of sufficient thickness to protect the object from oxidation and yet sufficiently thin to permit the pre-coating to substantially completely react with or dissolve in the molten Zn—Al bath, subjecting the precoated object to a surface activation treatment by immersing it in hydrochloric acid and thereafter allowing the surface to dry with a protective coating of a chloride salt, and thereafter immersing the object in the Zn—Al bath.

15 Claims, No Drawings

PRODUCTION OF A ZINC-ALUMINUM ALLOY COATING BY IMMERSION INTO MOLTEN METAL BATHS

This is a continuation-in-part of U.S. patent application Ser. No. 09/138,049, filed Aug. 21, 1998 now abandoned and which claims benefit of 60/088,555, filed Jun. 9, 1998, and bearing the title "Manufacturing Process For Noncontinuous Galvanization With Zinc-aluminum Alloys Over Metallic Manufactured Products." Said application, hereinafter referred to as the "'049 application," is hereby incorporated herein by reference in its entirety.

FIELD OF THE INVENTION

The present invention refers to an improvement in the production of a zinc-aluminum alloy coating by immersion into molten metal baths and, more precisely, it refers to an improved process to discontinuously coat metallic bodies with zinc-aluminum alloys, by immersion in molten baths of said alloy.

BACKGROUND OF INVENTION

State of the Art

The discontinuous coating of metal bodies with a zinc-aluminum alloy is disclosed in the '049 application. Also as disclosed therein, drawbacks were encountered whereby uneven coatings or bare spots were obtained. Prior to the method disclosed therein, acceptable coatings were obtainable only with difficulty and by complicated, time consuming procedures.

The '049 application discloses a very good solution to such drawbacks, essentially comprising a method whereby the metal bodies to be discontinuously coated are preferably electrolessly pre-coated with a metallic pre-coating, before the immersion in the zinc-aluminum molten bath. The pre-coating is preferably a metal chosen from the group consisting of copper and nickel. Cobalt could be used, but is not preferred for a number of reasons, including cost and toxicity. The pre-coating forms a very thin coating, permitting a good adhesion of the zinc-aluminum alloy.

However, even if a pre-coating is used, the final layer of zinc-aluminum alloy may present a number of adhesion, compactness and appearance defects, attributed to the formation of metal oxides during air drying after the pre-coating and prior to the immersion of the pre-coated metal body in the Zn—Al bath. Such oxides prevent a proper formation of the final coating. This outer oxidation layer, particularly for baths containing 0.1–25% wt. % Al, is a physical barrier against the inter-action or reaction of the pre-coating metal and the Al in the bath.

Attempts were made to eliminate such superficial oxidation through mechanical polishing with emery papers aided by a final treatment with alumina impregnated cloths. Another treatment utilized was a surface activation by pickling in diluted hydrochloric acid, followed by water rinsing and drying. Neither of these approaches yielded consistently satisfactory results.

It is an object of the present invention to avoid those drawbacks, through a surface conversion treatment resulting in a compact, continuous and glossy coating.

DESCRIPTION OF THE INVENTION

According to present invention, after metal bodies are pre-coated with a thin protective metallic layer, but before they are immersed in a zinc-aluminum alloy molten bath, they undergo a surface activation treatment by immersion in a diluted solution containing hydrochloric acid. The objective of the activation treatment is to form a salt layer on the pre-coated surface which protects the surface from further oxidation prior to immersion in the Zn—Al bath. By immersing the pre-coated metal object in hydrochloric acid, a reaction between the pre-coating metal and the hydrochloric acid occurs, thereby forming a chloride salt. When the object is then removed from the hydrochloride acid solution, the acid solvent is allowed to evaporate leaving a dry protective salt layer on the surface. When treatment of the pre-coated surface with hydrochloric acid is followed by water washing, poor results can occur due to the washing away of the salt solution on the object surface. When the surface is then dried, oxides can form on the surface, which oxides interfere with the subsequent galvanizing step in the Zn—Al alloy bath.

Moreover, and as is disclosed in the '049 application, the metallic pre-coating either substantially completely reacts with the Al in the Zn—Al bath (such as is the case with a Ni pre-coating to form an interface Ni—Al compound) or dissolves in the bath (such as is the case with a Cu pre-coating), thereby exposing the surface of the metal object to the Zn—Al alloy. It is therefore necessary that the chloride salt layer created by the activation step have a melting point below the temperature of Zn—Al bath, such that the chloride salt melts in a relatively short time upon immersion of the object in the Zn—Al bath. When Cu is used as the pre-coating metal, the preferred chloride salt that is formed is CuCl. As noted in the Handbook of Chemistry and Physics (CRC Press, $77^{th}$ Edition, 1996–1997, pp. 4–54 and 4–55), the melting point of CuCl is 430° C., which is sufficiently low to cause melting when the salt surface is immersed in a Zn—Al bath at a temperature above 430° C., e.g. 450° to 600° C. The melting point of $CuCl_2$, on the other hand, is 630° C., too high for consistently good results. In both instances, the chloride reacts with the Cu pre-coating. It is therefore preferred that the reaction between Cu and Cl be controlled so that excess Cl does not cause the CuCl reaction product to further react and form substantial amounts of $CuCl_2$. This is accomplished by controlling the Cl concentration in the hydrochloric acid bath, and/or by limiting the reaction time, for example by limiting the immersion time in the hydrochloric acid to a few seconds.

In general, the chloride salt or mixture of chloride salts should melt between about 300 and 600° C., depending upon the Zn—Al composition.

The activation bath may also contain an acid ionic or non-ionic surfactant, as well as one or more added chlorides of elements of groups IA, IIA, IB and IIB. The diluent for the hydrochloric acid is water or an alcohol chosen between methanol, ethanol, propanol, and the like, preferably ethanol and glycerol.

The formation of the thin pre-coating onto the metal body to be coated is obtained through electrolytic or electroless deposition or cementation. Cementation is preferred since it results in a very thin, monoatomic coating.

The concentration of the hydrochloric acid in the treatment solution preferably is between 5 and 20% vol., preferably between 10 and 15, while the added chlorides concentration preferably is between 10 and 100, preferably between 10 and 24, g/l.

Due to the complete evaporation of the solvent, the salts contained in said solution precipitate onto the pre-coated surfaces. In the case of pre-coating with copper, a mixture of cuprous chloride with the above salts is obtained, thus protecting from oxidation the copper surface and acting as fluxant, as they melt during immersion into the zinc-aluminum alloy bath, at a temperature between 430 and 600° C., depending upon the amount of aluminum in the alloy. This ensures a clear surface to be coated and thus a high quality coating.

The following Examples will show some preferred embodiments of present invention, without in any way limiting scope and objects of the invention.

EXAMPLE 1

Copper was coated on steel samples by cementation with ferrous ion, immersing said bodies for 20 s in an aqueous solution at room temperature, containing 10 g/l of $CuSO_4$ and of 98% $H_2SO_4$.

To improve the homogeneity of the copper coating, the superficial roughness of the steel samples was reduced and the surface oxides removed by polishing said surface with emery paper and with a final treatment with alumina impregnated cloths. After degreasing, the samples were copper coated by cementation, water rinsed, air dried and then immersed for 30, 60, 120, 240, 480, 960 s in a molten bath of zinc alloy containing 5% by weight of aluminum (Zn—Al 5%) at 450° C.

No immersion time gave good coatings. Though a very quick dissolution of the copper layer was expected, due to its very high solubility in molten zinc, copper was still present on the samples surface, even after long immersion times. As above discussed, this is attributed to surface oxidation of copper to $CuO_2$ before the immersion into the molten bath, or during the immersion, at the interface air/bath.

EXAMPLE 2

Steel samples were degreased, washed, pickled, rinsed and electrolitically copper coated (to a thickness of about 1 μm) in a solution at 40° C. containing 402 g/l of copper pyrophosphate, 98 g/l of potassium pyrophosphate, with addition of phosphoric acid to bring the pH to 8.5. A copper anode was utilized, with a current density of between 3 and 8 A/dm$^2$. The copper-coated samples were again rinsed and then air dried. Said samples underwent a surface activation treatment in 10% by weight hydrochloric acid, at room temperature for a few seconds, followed by water rinsing and air drying. They were then immersed in a Zn—Al5% molten bath at 450° C. for 4 minutes. Results were not reproducible, in that they are strongly dependant on the time between drying and immersion into the molten bath.

EXAMPLE 3

Copper was electrolitically coated onto steel samples, utilizing the same solution of Example 2.

The samples were degreased, washed, pickled, rinsed, copper coated, again rinsed and air dried. Then, they underwent a surface activation treatment in a 10% by weight HCl solution, at room temperature for a few seconds, followed by air drying at 50° C.

As solvents for HCl were separately utilized, water, methanol, ethanol, propanol, and glycerol. Mixtures of these solvents may also be used.

The samples were then immersed in a Zn—Al 5% molten bath at 450° C. for 4 minutes, and then extracted at a speed of about 15 mm/s.

All the samples, for any solvent utilized for the surface activation, were fully coated, with smooth, bright surfaces.

A SEM analysis, at a magnification of 1000×, of metallographic sections of the samples did not reveal any formation of fragile phases at the interface, with a coating total thickness of about 30 μm.

Adhesion of the coating was tested by 90° bending. The coating proved perfectly adherent and crack-free both in the compression and the elongation zones.

EXAMPLE 4

Since very good results were obtained with electrolitically coated samples, other experiments were carried out utilizing cemented samples. A copper coating was produced utilizing the solution of Example 1.

Samples were degreased, washed, pickled, rinsed, copper coated, again rinsed and then air dried. A surface activation treatment was then carried out, consisting in immersing for a few seconds the samples in a 10% b/w solution of HCl in glycerol, and then air drying them at 50° C.

The samples were then immersed for 4 minutes in a molten bath of Zn—Al 5% alloy at 440° C., and subsequently extracted at a rate of around 15 mm/s. The bath temperature can also be lowered, since with electroless coating a lower amount of copper to be dissolved into the bath is present on sample surfaces.

The coated sample surfaces had a very good appearance, without any fragile phases growth at the interface, with a coating thickness of about 30 μm.

EXAMPLE 5

The following Example also employed cementation as a copper coating technique.

The surface conversion treatment tested is reliable and yields coatings that are of good quality.

Samples are prepared by degreasing in a solution of 80 g/l solution of alkaline soap at 50–60° C. for 10 minutes, washing in demineralized water at room temperature, pickling in HCl 1:1 at room temperature for 3 minutes, and washing in demineralized water at room temperature. The cementation coating with copper follows, in a 10 g/l solution of copper sulfate and 10 g/l of 98% sulfuric acid, at room temperature for about 20 s. The samples are then rinsed, at room temperature, in demineralized water and then dried in air at 50–60° C. The surface conversion treatment is then carried out by immersion in a 1:10 solution of HCl in methyl alcohol at room temperature for a few seconds and subsequent drying in air blown at 50–60° C. The sample is then immersed in a molten Zn—Al 5% alloy bath at 440° C. for 3 to 4 minutes. Samples are then extracted from the bath at a rate of between 10 and 15 mm/s, and cooled in still air. Consistently good coatings are obtained.

EXAMPLE 6

Various Zn—Al baths were tested, with varying concentrations of Al. Al ranges below 0.0005% also were tested, although these concentrations are so low as not to yield the corrosion-resistant properties of Zn—Al coatings having higher Al concentrations (e.g. >0.1%, preferably about 5%, and up to 25% or even higher). Also, the problems heretofore encountered with higher Al-content Zn—Al coatings are not encountered with very low Al concentrations (i.e., conventional Zn coatings result). In the following tests, an electroless Cu flash to a thickness of 0.3 μm was followed by hot-dip into Zn—Al at 450° C., 6 min. immersion time.

| wt. % | Activation | No activation | |
|---|---|---|---|
| Zn 99.999 | | X | Good coating quality completely covering workpiece |
| Zn + 0.0005 Al | | X | Good coating quality completely covering workpiece |
| Zn + 0.005 Al | | X | Workpiece not completely coated |
| Zn + 0.005 Al | X | | Good coating quality completely covering workpiece |
| Zn + 0.1 Al | | X | 10% uncoated area |
| Zn + 0.1 Al | X | | Good coating quality completely covering workpiece |
| Zn + 0.5 Al | | X | 50% uncoated area |
| Zn + 0.5 Al | X | | Good coating quality completely covering workpiece |
| Zn + 5 Al | | X | 80% uncoated area |
| Zn + 5 Al | X | | Good coating quality completely covering workpiece |

Though the invention was described with reference to a treatment in a molten Zn—Al 5% b/w bath, the aluminum content can be varied in a vast composition field, generically comprised between 1 and 60% b/w, without substantial modifications to the process.

What is claimed is:

1. A process for non-continuous galvanization of a metal object with a Zn—Al alloy in a molten Zn—Al alloy bath comprising:

pre-coating the surface of the metal object with a metallic pre-coating layer so that a uniform, continuous, thin coating of metal is obtained sufficient to protect the surface of the object from oxidation prior to dipping into the galvanization bath, and yet sufficiently thin that the pre-coating can substantially completely react with Al in a molten Zn—Al alloy bath or be substantially completely dissolved in the bath;

subjecting the pre-coated surface to a surface activation treatment comprising immersing the pre-coated object in a dilute solution of hydrochloric acid, thereby forming on the surface of the pre-coated object a protective layer comprising chloride salt coating having a melting temperature below the temperature of the molten Zn—Al alloy bath, and dipping the pre-coated metal having the protective chloride salt coating into a molten Zn—Al alloy bath and controlling the temperature and dipping time such that the chloride salt melts and the pre-coating substantially completely reacts with Al in the bath to form an interface compound layer or substantially completely dissolves in the bath, thereby causing the ZnAl alloy bath to react with the surface of the metal object and form an adherent layer and produce a continuous galvanized coating.

2. A process according to claim 1, wherein the metallic pre-coating layer comprises at least one of copper and nickel.

3. A process according to claim 2, wherein the metallic pre-coating layer comprises copper.

4. A process according to claim 2, wherein the metallic pre-coating layer comprises nickel.

5. A process according to claim 1, wherein the metallic pre-coating layer comprises cobalt.

6. A process according to claim 2, in which said metal bodies after the surface activation treatment are extracted from the treating solution and directly dried without rinsing.

7. A process according to claim 2, in which the diluting agent for hydrochloric acid is chosen between water and alcohol.

8. A process according to claim 7, in which said alcohol is at least one of methanol, ethanol, propanol and glycerol.

9. A process according to claim 2, in which said pre-coated layer is obtained by a method chosen among electrolytic deposition, electroless deposition and cementation.

10. A process according to claim 2, in which the hydrochloric acid concentration in said diluted solution is between 5 and 20% by volume.

11. A process according to claim 10, in which the hydrochloric acid concentration is between 10 and 15% by volume.

12. A process according to claim 2, in which chlorides are added to the hydrochloric acid solution, and in which the concentration of said chlorides added to the hydrochloric acid solution is between 10 and 100 g/l.

13. A process according to claim 12, in which the concentration of said chlorides added to the hydrochloric acid solution is between 10 and 25 g/l.

14. A process according to claim 3, wherein the protective chloride salt coating comprises sufficient CuCl to maintain the melting point of the coating below the melting point of the molten Zn—Al alloy bath.

15. A process according to claim 14, wherein the protective chloride salt coating has a melting point below 600° C.

* * * * *